United States Patent [19]

Paulson et al.

[11] 3,956,096

[45] May 11, 1976

[54] APPARATUS FOR PLATING AIRCRAFT CYLINDERS

[75] Inventors: Peter C. Paulson, Pinole; Henri H. Henderson, Oakland; Richard L. Worstell, Moraga, all of Calif.

[73] Assignee: Electro-Coatings, Inc., Moraga, Calif.

[22] Filed: Dec. 26, 1974

[21] Appl. No.: 536,437

Related U.S. Application Data

[62] Division of Ser. No. 344,142, March 23, 1973.

[52] U.S. Cl. ..... 204/237; 204/26; 204/272

[51] Int. Cl.[2] ..... C25D 1/02; C25D 3/04

[58] Field of Search ..... 204/26, 237, 260, 272, 204/DIG. 7

[56] References Cited

UNITED STATES PATENTS

| | | | |
|---|---|---|---|
| 2,048,578 | 7/1936 | Van Der Horst | 204/272 X |
| 2,431,948 | 12/1947 | Martz | 204/272 |
| 2,856,344 | 10/1958 | Lapham | 204/272 |
| 2,980,593 | 4/1961 | Larson | 204/26 |
| 3,065,153 | 11/1962 | Hough et al. | 204/272 X |

*Primary Examiner*—Howard S. Williams
*Assistant Examiner*—A. C. Prescott
*Attorney, Agent, or Firm*—Limbach, Limbach & Sutton

[57] ABSTRACT

Method and apparatus for chromium plating aircraft cylinder assemblies in which a non-conductive shield is provided in the head space of the cylinder and the electrolyte is pumped through the space between the anode and cylinder wall to produce dramatically high plating rates on the interior cylinder wall and no plating in the head space while eliminating the need for waxing the interior surfaces of the head.

3 Claims, 3 Drawing Figures

APPARATUS FOR PLATING AIRCRAFT CYLINDERS

RELATED APPLICATION

This is a division of our co-pending application Ser. No. 344,142 filed Mar. 23, 1973.

BACKGROUND OF THE INVENTION

For many years it has been known that the worn interior surfaces of aircraft cylinder assemblies can be rebuilt by plating those surfaces with a layer of chromium in a special way which produces a micro-cracked pattern on the chromium so that the chromium layer will be wetted by oil. See for instance the following United States patents:

| Patent No. | Inventor |
|---|---|
| 1,441,468 | C. H. Wills |
| 2,048,578 | H. Van Der Horst |
| 2,412,698 | H. Van Der Horst |
| 2,433,457 | T. C. Jarrett, et al. |
| 2,856,344 | S. D. Lapham |
| 2,980,593 | C. R. Larson |
| 3,192,618 | G. A. Altgelt |

The aircraft cylinder assembly generally comprises a thin walled steel cylinder which receives the piston of a reciprocating piston engine with the outer end of the steel cylinder attached to an aluminum head portion which carries suitable valve seats, fuel inlet and exhaust passageways and the like. In the commercial application of this known method of rebuilding, it has been conventional to dip the head portion of the cylinder assembly in wax to a sufficient depth that the interior surfaces of the aluminum head are coated with wax before plating. The wax layer on the aluminum surfaces prevents plating of the chromium on the head portion, thereby limiting the chromium layer to the desired interior area of the cylinder. The "waxed" cylinder assembly is attached to an anode and the combination is then lowered into a chromium plating bath and plated for sufficient time to build up the desired chromium thickness of the interior of the cylinder. Thereafter the combination is removed from the plating bath and post treated to develop the micro-cracks. The cylinder assembly is then removed from the anode and the wax is removed to provide a clean part for subsequent honing, grit blasting and the like.

The necessity for the waxing operation in this method of rebuilding cylinder assemblies has created serious problems. Thus, the manual steps involved in applying and removing the wax coating are time consuming and expensive. More importantly, the waxing operation has been a source of errors which are responsible for the rejection of rebuilt cylinders. For instance, a microscopic particle splashed in the interior surface of the cylinder during the waxing operation will produce a pit in the chromium layer, and incomplete removal of the wax prior to grit blasting can cause the entrapment of grit particles in screw threads with resulting damage to the rebuilt assembly when screws are inserted in the threads. There is also the possibility that entrapped grit will be released into the engine's lubrication system during engine operation.

SUMMARY OF THE INVENTION

In accordance with this invention we have found that waxing the head portion of cylinder assemblies can be eliminated during chromium plating, and dramatic improvements may be achieved in plating rate by supporting a non-conductive electrical shield in the head space of the cylinder assembly during plating and pumping the electrolyte at high speed through the space between the interior surface of the cylinder and the exterior surface of the anode.

This improved plating method permits new arrangement of plating equipment in which the aircraft engine cylinder assemblies can be handled much more easily than they have been handled in the old method. Thus, our method preferably employs a plating apparatus in which the heavy anode structure of the apparatus is mounted in a fixed vertical position with the electrical shield on its upper end, and aircraft cylinder assemblies to be plated can be manually placed over the anode, locked into place and connected to a source of electrolyte pumped into the interior of the cylinder. In this way the cylinder assembly can be handled manually without the necessity of using hoists for lifting and moving the heavy anode structure.

The electrical shield may be supported in the head space of the cylinder assembly in a number of ways, but we prefer to support it by attaching it directly to the end of the anode, and the electrical shield may take the form of a non-conductive block or merely a non-conductive coating on the end of the anode with a fairly small passage between the shield and the upper end of the steel cylinder to be plated. The purpose of the shield is to prevent "throwing" of chromium plating from the anode to the interior surfaces of the head portion of the cylinder assembly.

A variety of arrangements may be employed for pumping the chromium plating electrolyte and handling the return flow of electrolyte to the pump, but we prefer to employ an arrangement where the electrolyte is pumped into a moat adjacent to the mouth of the cylinder hence axially through the cylinder and around the electrical shield to be exhausted through the existing fuel and exhaust passageways of the head portion. The electrolyte can be pumped through a hollow anode and the like, but the arrangement described above is preferred for the ease of construction and maintenance.

We have found that our improved method permits cylinder assemblies to be plated with the electrolyte in direct contact with the interior surfaces of the head portion while eliminating the necessity for the waxing operation. Additionally, we have with this method obtained substantial improvements in the rate at which the chromium plating layer can be deposited on the interior surface of the cylinder. While the particular conditions for plating can be varied over fairly wide limits and adjustments can be made in electrolyte temperature, chromium concentration, electrolyte pumping rate and plating current, we prefer to operate at a temperature of about 149° F at a plating rate of approximately 6 amperes per square inch and a chromic acid concentration of 33 ounces of $CrO_3$ per gallon of solution and a sulfate ion concentration of 0.275 per gallon of solution giving a $CrO_3/SO_4$ ratio of 120/1. The rate at which the electrolyte is pumped through the cylinder should be high enough that no appreciable change in temperature occurs along the length of the cylindrical surface being plated. A temperature gradient of 1° can be tolerated but preferably the solution is pumped sufficiently fast that a temperature gradient of more than 1° does not occur because a temperature gradient of more than 1° may cause an appreciable change in the micro-cracked pattern over the length of the cylinder. Additionally, the pumping rate is preferably maintained sufficiently high that, even at these high current densities, the current density is fairly uniform along the length of the cylinder. Thus, if the electrolyte flow rate is too low, there will be a significant increase in the electrical resistence of the electrolyte solution near the downstream end of the cylinder because of increased concentration of hydrogen gases, and increase in the electrolyte flow rate may prevent this problem.

Apart from these features of our method, we believe that high velocity electrolyte flow along the surface of the cylinder being plated contributes to the ability of our method to achieve the high plating rates which we have achieved.

While a wide variety of structures may be used for the purpose of this invention, we prefer to employ the structure illustrated in the attached drawings in which.

DETAILED DESCRIPTION

Figure 1:
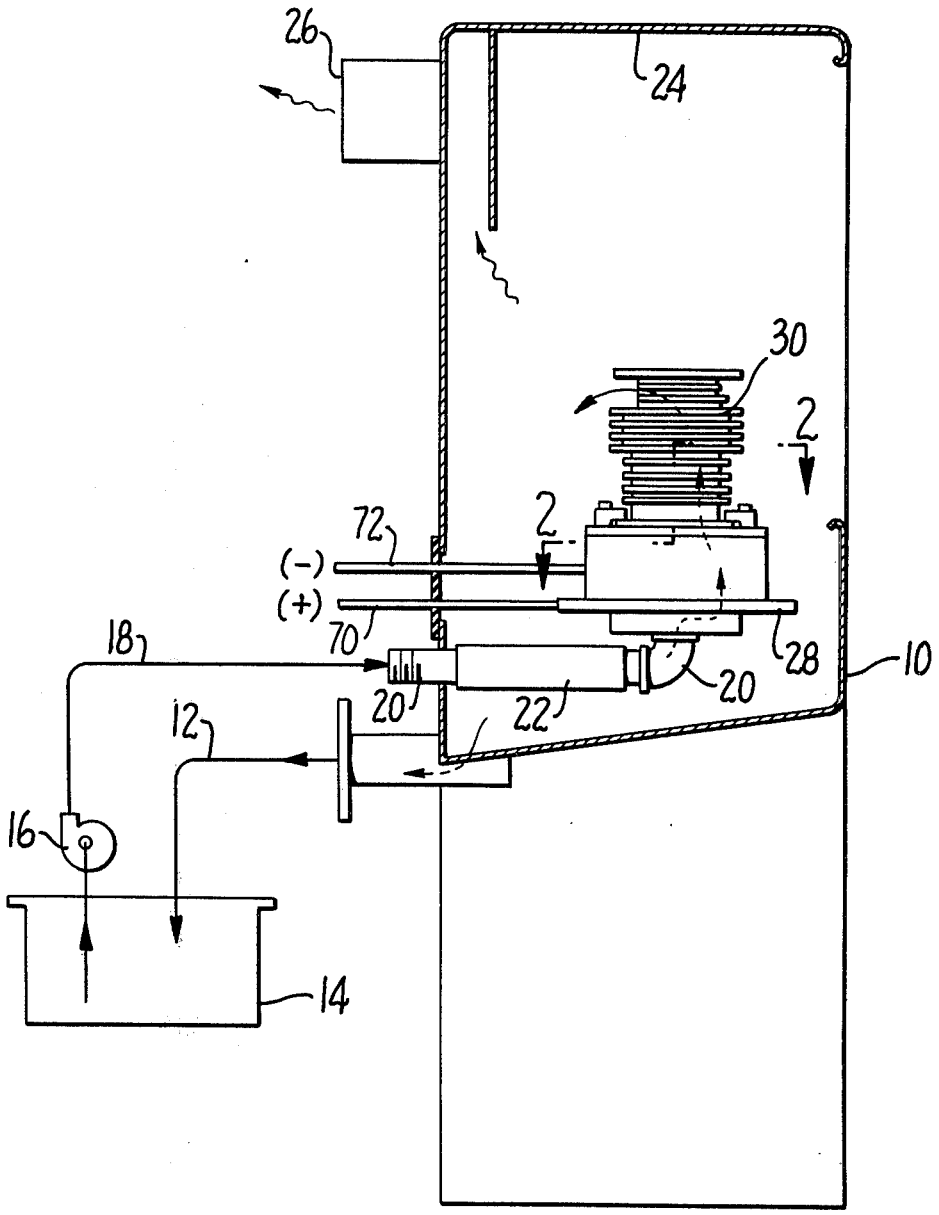
FIG. 1 is a side elevation of the plating apparatus of this invention constructed for practicing the method of this invention.
Figure 2:
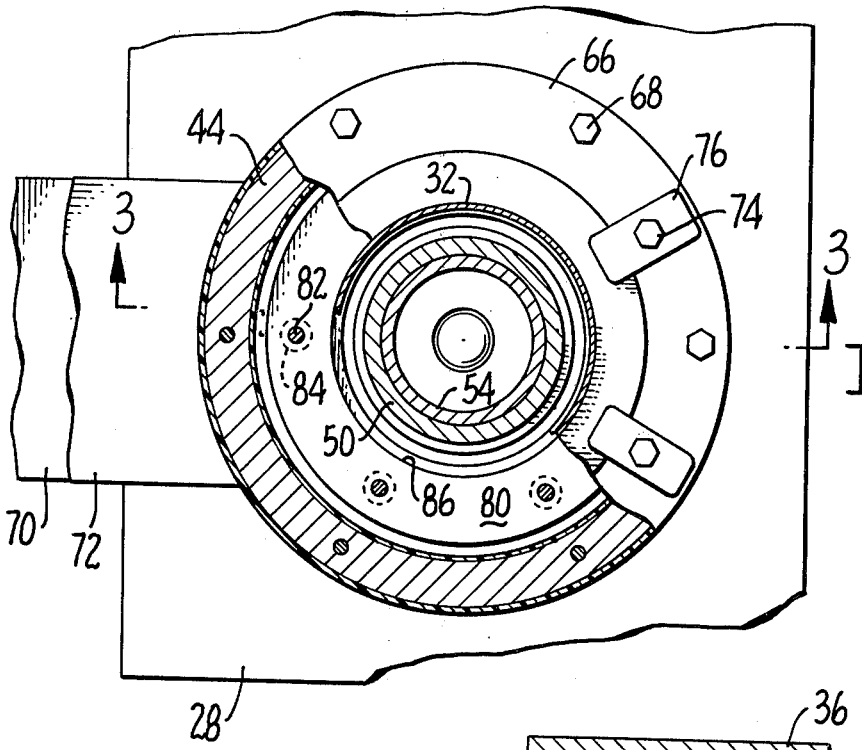
FIG. 2 is an interior plan view taken along the plane indicated at 2—2 in FIG. 1 with the aircraft cylinder assembly of FIG. 3 removed.

Referring now in detail to the drawings, and particularly to FIG. 1, the electrolyte plating apparatus illustrated therein comprises a housing 10 connected by a conduit 12 to a heated electrolyte reservoir 14. A pump 16 connected via a conduit 18 supplies electrolyte to an electrolyte conduit 20. As is well known in the art, electrical insulators such as 22 may be inserted in these conduits for electrical isolation. Preferably the apparatus includes a hood 24 for noxious fumes with an exhaust outlet 26. A base member 28 is mounted inside a housing 10 by any suitably means electrically isolated from the housing, and an aircraft cylinder assembly 30 is mounted on the base as indicated in greater detail in FIG. 3.

Figure 3:
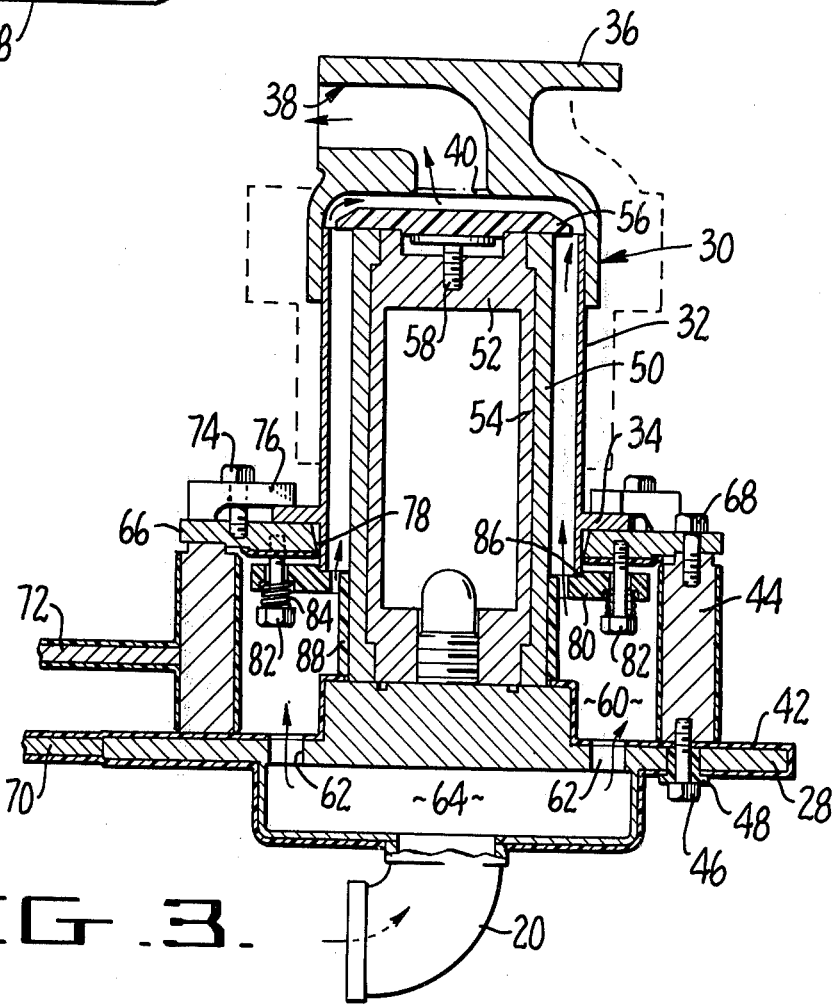
FIG. 3 is an interior sectional view taken along the plane indicated at 3—3 in FIG. 2 and showing the aircraft cylinder somewhat schematically.

The aircraft cylinder assembly illustrated somewhat schematically in FIG. 3 includes a steel cylinder portion 32 having a mounting flange 34 by which the cylinder is attached to an aircraft engine with an aluminum head portion 36 attached to the cylinder 32 in conventional manner. The head portion 36 carries a passageway 38 surrounded by a valve seat 40 through which fuel or exhaust gases pass during operation of the engine. The aircraft engine cylinder 30 is prepared for mounting in the apparatus of FIG. 3 by conventional techniques where bushings, screws and the like may be removed, cracks in the head portion 30 may be welded and the like. However, the interior surfaces of the head portion 36 need not be coated with wax for plating in accordance with this invention though wax coating may be used where it may be desired to obtain the high plating rates of this invention but eliminate the electrical shield mentioned above.

As indicated in FIG. 3 the base member 28 carries a non-conductive coating, for instance, a coating 42 of polyvinyl chloride approximately 3/22 of an inch thick. A dike 44 is mounted on the base 28 electrically isolated therefrom by means of bolts 46 and insulator bushings and an anode assembly 50 is mounted on the base 28 electrically connected thereto. The anode has a steel structural interior 52 and a platinum plated titanium exterior sleeve 54. A shield 56 of electrical insulating material is attached to the top of the anode assembly by a screw 58 formed on the shield.

A moat 60 for electrolyte is formed between the anode 50 and the dike 44, and the moat is connected by openings 62 in the base member 28 to an electrolyte supply manifold 64 connected by suitable fittings to the electrolyte supply conduit 20.

A support ring 66 is mounted on top of the dike 44 by bolts 68, and the electrical buses 70 and 72 having a direct current electrical supply are connected between the base member 28 and the dike 44. Where desired, of course, the dike 44 may be made of an insulating material and the bus 72 connected directly to the support ring 66.

The mounting flange 34 of the aircraft engine cylinder assembly is clamped onto the support ring 66 by means of bolts 74 and clamps 76, and it will be noted that the interior surface 78 of the support ring 66 is accurately machined and tapered to position the cylinder 32 concentrically on the anode 50 before the clamps 74 are tightened.

An insulator ring 80 is suspended onto support ring 66 by bolts 82 and support springs 84 so that the insulator ring 80 bears against the lower throat of the cylinder 32, and a shoulder 86 may be provided on the ring to facilitate accurate positioning of the cylinder assembly. The interior surfaces of the moat are coated with insulator layers of polyvinyl chloride and a polyvinyl chloride sleeve 88 is provided around the base of the anode so that the anode is exposed in confronting relationship to the interior of the cylinder assembly 30 only along the interior surfaces of the cylinder 32.

The ring 80 and the sleeve 88 provide a narrow throat through which electrolyte passes as it moves from the moat 60 to the space between the cylinder 32 and anode 50 and this narrow throat is important in providing a uniform distribution of electrolyte flow around the circumference of the anode.

This apparatus may be operated in accordance with our invention in the following manner where it may be considered that the particular aircraft cylinder is a Continental Model IO-470 with the interior surfaces of the cylinder and plating apparatus drawn to scale in the accompanying drawings. Under these circumstances, high quality chromium plating of the interior surfaces can be obtained with a chromium plating electrolyte composed of 33 ounces of $CrO_3$ per gallon of solution containing 0.275 ounces of $SO_4$ ion per gallon maintained at a temperature of 149° F. This electrolyte is pumped through the apparatus in through conduit 20 and out through passsageway 38 at a flow rate of 25 gallons per minute, and a direct current plating current is applied between buses 70 and 72 at the rate of 675 to 690 amperes giving a current density of 6 amperes per square inch. These plating conditions can be varied substantially for different model cylinders and for different plating conditions of the Continental IO-470 but we have found these particular conditions to be very satisfactory for this particular cylinder.

Obviously many modifications can be made in the structure of the plating apparatus. In some situations it may be desirable to extend the anode 50 directly through the base 42 so that the base 42 is not electrically connected to the anode. The particular structure shown for supporting the cylinder assembly on the plating apparatus may be changed, but preferably the cylinder assembly is supported by clamping the mounting flange 34 to avoid distortion of the thin cylinder walls 32 during plating. Many additional modifications of the invention may be made without departing from the spirit and scope of the invention.

We claim:

1. Apparatus for plating aircraft engine cylinder assemblies which comprises:

A. A base portion,

B. A substantially cylindrical anode mounted on said base portion with a non-conductive electrical shield on its end remote from said base and projecting generally radially outwardly from said anode, C. Electrolyte pumping means for pumping a plating electrolyte around said anode adjacent to said base portion, D. Electrically insulated clamping and sealing means for holding an aircraft engine cylinder assembly around said anode with the interior of said cylinder assembly connected to said pumping means for conducting electrolyte through the space between the cylinder interior and the anode, E. Conductor means for passing direct electrical current between said anode and said cylinder assembly.

2. The apparatus of claim 1 characterized further in that said pumping means comprises means for recirculating electrolyte from an aircraft engine cylinder near said remote end of said anode back to a location around said anode near said base portion.

3. Apparatus for plating aircraft cylinder assemblies characterized by a head portion having an opening passageway through it and an open cylinder portion extending downwardly from said head portion and having a mounting flange around the lower end of the cylinder portion comprising:

A. a base member,

B. a substantially cylindrical anode mounted on said base member projecting upwardly therefrom and having a nonconductive electric shield on the end of the anode remote from the base, said shield projecting radially outwardly from said anode, C. a dike member mounted on said base surrounding a portion of said anode adjacent said base and defining a moat between said dike and said anode, said dike member being electrically insulated from said anode, D. clamping means for clamping the flange of an aircraft cylinder assembly to said dike to define an annular space between said cylinder assembly and said anode, E. a passageway between said moat and said annular space between said cylinder assembly and said anode, F. pumping means for pumping a plating electrolyte into said moat, through the annular space between said anode and said cylinder assembly mounted on said dike and through the open passageway in the head portion of said cylinder assembly, and G. conductor means for passing direct electric current between said anode and said cylinder assembly mounted on said dike.

* * * * *